US008465075B2

(12) United States Patent
Ackermann

(10) Patent No.: US 8,465,075 B2
(45) Date of Patent: Jun. 18, 2013

(54) DEVICE FOR INVESTIGATING THE VICINITY FOR A VEHICLE AND METHOD FOR ITS PRODUCTION

(76) Inventor: Klaus Ackermann, Munich (DE)

( * ) Notice: Subject to any disclaimer, the term of this patent is extended or adjusted under 35 U.S.C. 154(b) by 63 days.

(21) Appl. No.: 13/177,954

(22) Filed: Jul. 7, 2011

(65) Prior Publication Data

US 2013/0009420 A1 Jan. 10, 2013

(51) Int. Cl.
*B60P 1/00* (2006.01)

(52) U.S. Cl.
USPC ..... 296/26.04; 296/165

(58) Field of Classification Search
USPC ..... 296/26.04, 26.05, 26.06, 165, 175, 296/99.1; 89/36.07–36.12
See application file for complete search history.

(56) References Cited

U.S. PATENT DOCUMENTS 6,325,447 B1 * 12/2001 Kuo ..... 296/165
7,712,409 B2 * 5/2010 Cunningham et al. ..... 89/36.09
7,726,675 B2 * 6/2010 Ben-Ari et al. ..... 280/149.2

* cited by examiner

*Primary Examiner* — Lori Lyjak
(74) *Attorney, Agent, or Firm* — Andrew M. Calderon; Roberts Mlotkowski Safran & Cole, P.C.

(57) ABSTRACT

An armored vehicle has a bottom section which is located on the bottom of the vehicle, at least one armored side section which is located on the side of the vehicle and an armored roof plane which is located on a roof section of the vehicle. In the region of the roof section there is at least one observation position which can be moved in translation by at least one mechanism attached to a carrier, and the observation position is made in one piece and the observation position is made of a transparent material.

29 Claims, 7 Drawing Sheets

DEVICE FOR INVESTIGATING THE VICINITY FOR A VEHICLE AND METHOD FOR ITS PRODUCTION

FIELD OF THE INVENTION

This invention relates to a device for reconnoitering the vicinity for a vehicle, especially for an armored vehicle, comprising a bottom section which is located on the bottom of the vehicle, at least one armored side section which is located on the side of the vehicle and an armored roof plane which is located on a roof section of the vehicle, and a method for its production.

DISCUSSION OF BACKGROUND INFORMATION

Vehicles with observation positions have different purposes. In an armored version these vehicles are used to create a secure observation space. Especially at locations in which disorder prevails, armed conflicts are taking place or there is some other potential for danger, there is a great demand for vehicles which offer the passengers sufficient safety without adversely affecting their activity. Unarmored, these vehicle are also used among others for hunting purposes. In terms of prior art only vehicles which have an observation position permanently mounted on the vehicle roof are known. This type of observation post on the one hand offers very limiting viewing opportunities and is easy to notice since it is installed permanently in the vehicle; in critical cases this can be a decisive disadvantage. Furthermore folding roof superstructures or extensions are known. But they do not offer a panoramic viewing possibility and are thus made such that there is only little protection against external effects. There is no protection against projectiles or explosives. Moreover, special vehicles are known which enable individuals who must be protected to move protected through a crowd and at the same time to look in all directions in order to be seen. Due to their special construction these vehicles cannot be camouflaged as ordinary vehicles; this makes it easier for potential attackers to identify their target. Furthermore, retrofitting for existing vehicles is difficult to impossible. There is no possibility of moving the observation position.

SUMMARY OF THE INVENTION

Therefore the object of the invention is to devise a way in which in or on a vehicle of the initially mentioned type a space can be easily formed with relatively low cost to ensure viewing as extensive as possible with optimum protection of passengers.

This object is achieved as claimed in the invention by the features of the claimed invention.

Other advantageous configurations are given by the features of the dependent claims.

This invention is based on the idea that a vehicle comprises a bottom section which is located on the bottom of the vehicle, at least one armored side section which is located on the side of the vehicle, and an armored roof plane which is located on a roof section of the vehicle, in the region of the roof section there being at least one observation position which can be moved in translation by at least one means which is attached to a carrier, the observation position being made in one piece and the observation position being made of a transparent material. This enables better and safer observation of the vicinity; this results in increased safety of the vehicle passenger. The user of the observation position of the vehicle thus has a 360 degree panoramic view as claimed in the invention due to transparent protective material. The observation position is made movable, therefore can be extended and retracted. The observation position can be retracted into the vehicle such that it is not visible from the outside. It is thus impossible to detect whether it is an armored vehicle. As claimed in the invention the observation position can be made in one piece to increase protection and reduce effort and costs.

According to one advantageous configuration of the invention, the means attached to the carrier is an attachment and/or lifting means by which the observation position can be axially fixed. The observation position as claimed in the invention is attached to the carrier by the attachment and/or lifting means. The observation position can be extended and retracted by actuating the attachment and/or lifting means.

According to another advantageous configuration of the invention the carrier is formed within or entirely or partially outside the vehicle, especially in the region of the roof section. The different manners of installation make it possible to mount the device on the vehicle as necessary. This entails both new structures and also retrofitting of existing vehicles. The observation position is preferably located in the roof section in order to enable a field of vision as wide as possible.

According to still another advantageous configuration of the invention the vertical position of the observation position can be changed by the lifting means, the lifting means acting electrically and/or hydraulically and/or mechanically and/or pneumatically and/or it can be manually actuated. In this way the observation position can be extended and retracted with little or no expenditure of force. Manual actuation for a case of danger is alternatively possible.

As claimed in the invention, the vertical path of movement of the observation position is in the range from 10 to 200 cm, especially between 10 cm and 50 cm, the bottom element of the observation position being located at least partially in the carrier. This ensures that the observer can perform his function kneeling, sitting and standing, the safety of personnel being ensured at any time. Advantageously the observation position can be moved fax enough to enable the best possible view.

According to another configuration of the invention, the observation position is made stationary on the roof section, the lifting means being replaced by a fixed support. This enables even faster and more economical production.

Advantageously the observation position is made in the form of a hollow body such as a cuboid and/or cupola and/or a truncated pyramid and/or a cylinder and/or a pyramid and/or a cone and/or a truncated cone and/or a gable which has an opening downward. In this way the design which best supports the current application can be chosen according to criteria such as aerodynamics, costs or installation possibility.

According to another advantageous configuration of the invention, at least one side element and/or at least one roof element and/or at least one bottom element of the observation position can be connected using connecting means at least one connection site, positively, nonpositively and/or adhesively. The host of connection possibilities enables a choice matched to need which takes into account the respective form and function.

Preferably the side elements and the roof element of the observation position can be connected by means of bolting and/or cementing and/or riveting and/or tacking. As mentioned above, a reliable connection of proper form can be established in this way.

As claimed in the invention at least one seal is mounted between the observation position and the carrier. In this way the penetration of dirt and water into the interior is prevented and the pressure wave of a detonation is attenuated.

According to one preferred configuration of the invention the observation position and/or the carrier have a telescoping mechanism. This enables a more compact and thus space-saving construction with the maximum height remaining the same.

According to another advantageous configuration of the invention, the observation position and the part of the carrier made above the armored roof section are made of a material with which the pressure wave of a detonation and/or of a round and/or an impact can be diverted. This ensures the intactness of the interior of the observation position and thus the individuals who are located in it.

Preferably the observation position is made of a glass and/or ceramic glass. In this way a protected panoramic view is enabled for the users. According to one advantageous configuration of the invention one region of the observation position is made as an escape hatch consisting of an opening and closing site. It can be both a door made as part of the observation position, and as a device which enables the complete observation position to be folded up or away and/or removed. The escape hatch enables the vehicle passengers to leave their vehicle in case of danger; this increases the chances of an injured passenger surviving mainly in armored vehicles which can only be opened with great difficulty by rescue forces in case of damage. Alternately the observation position can also be made without an escape hatch.

According to another advantageous configuration of the invention, within the observation position there is at least one measurement and/or observation and/or transmitting and/or receiving means. This offers users such as for example reporters in crisis areas a protected communications and recording possibility. Furthermore the sensors of self-contained vehicles can be placed there.

Preferably the roof section of the vehicle can be used as a carrier, at least one part of the observation position being located at a site within the roof section. In this way both faster and more economical production and a more compact construction are enabled.

BRIEF DESCRIPTION OF THE DRAWINGS

Embodiments of the invention are shown schematically in the drawings and are detailed below.

DETAILED DESCRIPTION OF THE PRESENT INVENTION

Figure 1:
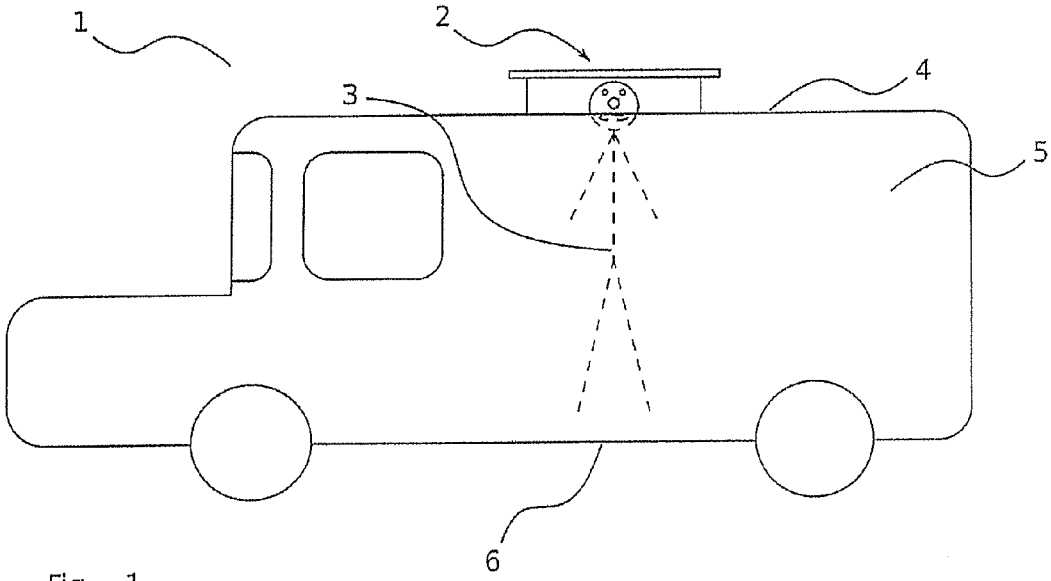
FIG. 1 shows a schematic side view of a vehicle with the observation position as claimed in the invention.

FIG. 1 shows a schematic side view of a vehicle 1 with the observation position 2 as claimed in the invention. The vehicle 1 comprises a bottom section 6 which is located on the bottom of the vehicle 1, an armored side section 5 which is located on the side of the vehicle 1 and an armored roof section 4 which is located on a roof of the vehicle 1 and an observation position 2 which is located in the region of the roof section 4. For this purpose it is shown how the observation position 2 is used by an individual 3 in the vehicle 1.

Figure 2:
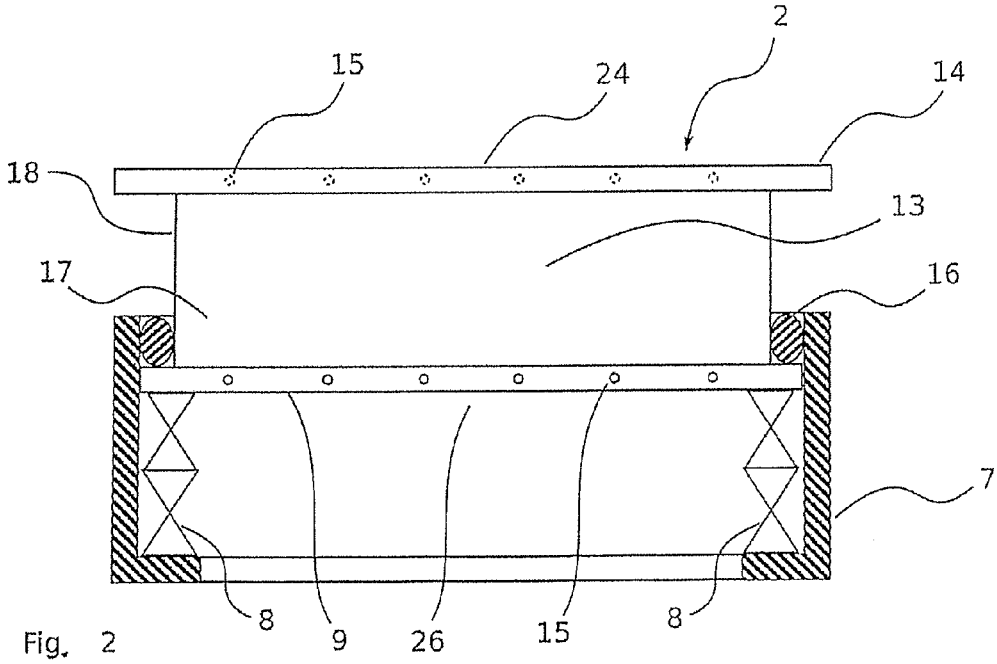
FIG. 2 shows a schematic side view of an observation position in the extended state as claimed in the invention as shown in FIG. 1.

FIG. 2 schematically shows the structure of an observation position as claimed in the invention. The observation position 2 consists of a roof element 14 and a bottom element 9 parallel to it as well as four side elements 13 which are perpendicular thereto and which are arranged at a right angle to one another, and with the roof element 14 and the bottom element 9 form a hollow body 26 in the form of a cuboid 18 which has an opening 26 downward.

The side elements 13 are each connected to the roof element 14 and the bottom element 9 on the connection sites 15 which are uniformly distributed over the periphery. The side surfaces are made of a transparent material 17 which is used to allow the observer the widest possible view. Furthermore the interior of the vehicle is protected against attacks from the outside, such as explosions or rounds. Therefore an especially durable material such as for example armored or ceramic glass should be used.

The roof element 14 is made of an armored material, the use of a transparent material such as for example glass or armored glass also being possible.

The bottom element 9 of the observation position 2 is guided in a carrier 7 in the vertical direction. The carrier 7 is made of a bulletproof and explosion-proof material, for example armor steel, and is mounted on or in the roof of a vehicle which is not shown, positively, adhesively and/or nonpositively.

A seal, for example a shaft strip seal, runs between the top end of the carrier and the side elements 13.

On the carrier 7 there is an attachment and lifting device 8 which acts on the bottom element 9 and fixes the observation position 2 in the axial direction. It can be a mechanical, pneumatic, electrical or hydraulic system, or a hybrid system. In this way the observation position 2 is moved in the vertical direction and is thus extended and retracted. The observation position can also be moved manually for example in emergencies. The path of movement, depending on the height of the observation position 2, is between 10 cm and 200 cm, especially between 10 cm and 50 cm.

Figure 3:
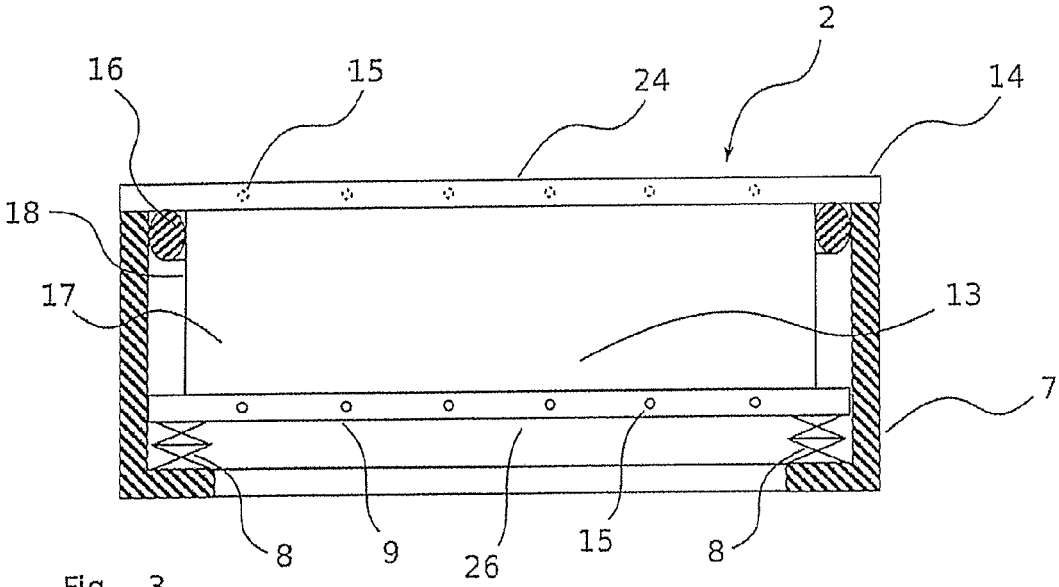
FIG. 3 shows a schematic side view of the observation position in the retracted state as shown in FIG. 2.

FIG. 3 shows the observation position 2 as claimed in the invention from FIG. 2 in the retracted state. As claimed in the invention, the observation position 2 is retracted into the carrier 7 by moving the attachment and lifting means 8 which is fixed to the carrier 7. In the retracted state the roof element 14 is in contact with the carrier 7. With flush installation the roof element 14 of the observation position 2 can no longer be recognized from the outside.

Figure 4:
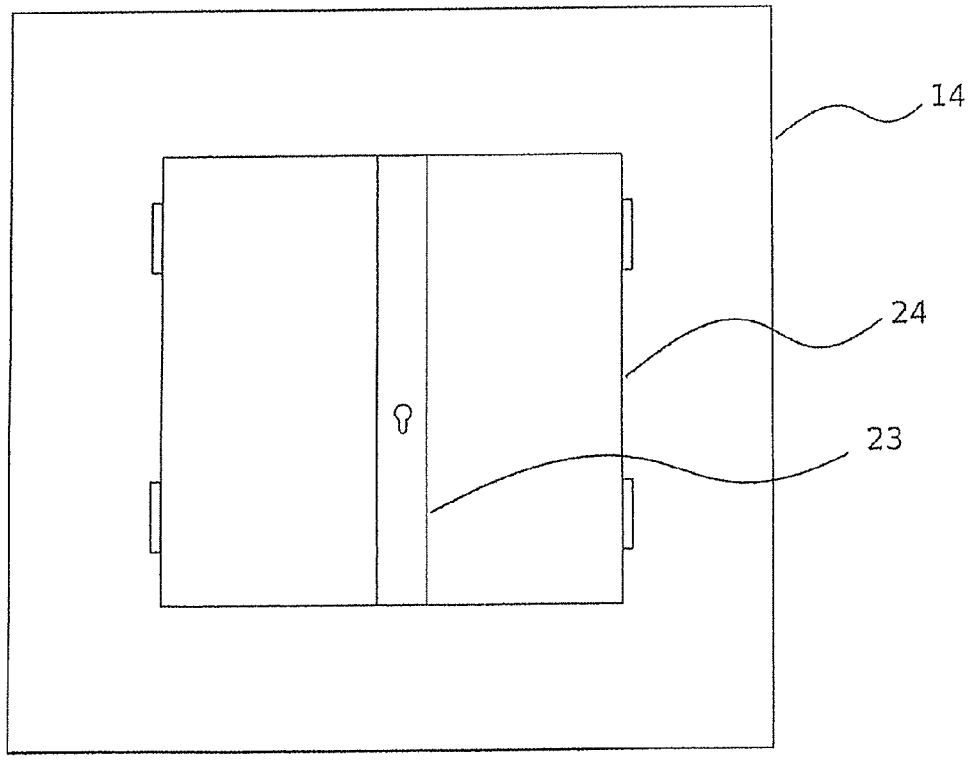
FIG. 4 shows a schematic plan view of the observation position of FIG. 2 and FIG. 3.

FIG. 4 shows a plan view of the observation position 2 as claimed in the invention from FIGS. 2 and 3. In the region of the roof element 14 of the observation position an opening and closing site 23 is made as an escape hatch 24. In an emergency the escape hatch 24 can be manually opened.

Figure 5:
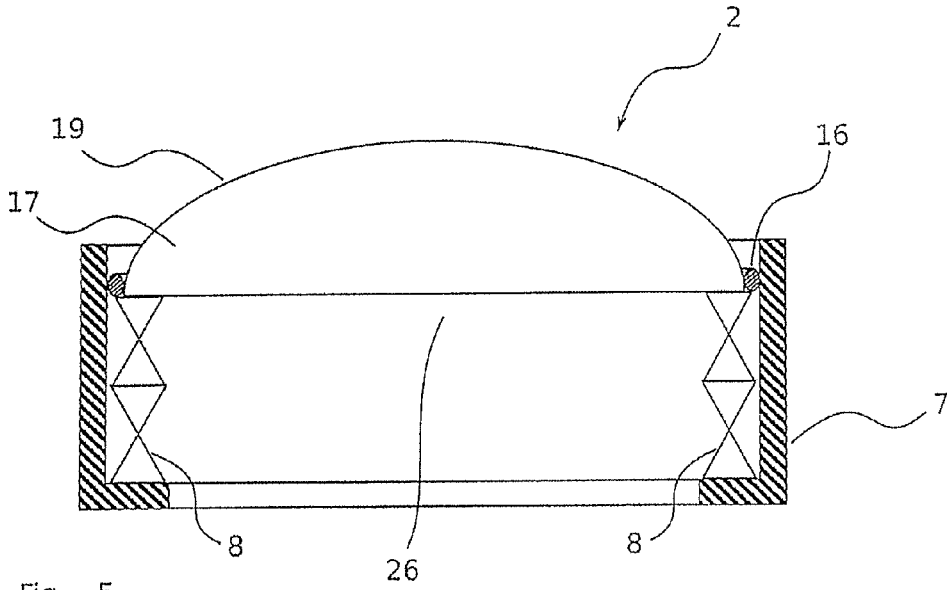
FIG. 5 shows a schematic side view of the observation position of the second embodiment.

FIG. 5 shows a side view of a one-piece observation position 2 made as a cupola 19. A seal 16 is mounted between the observation position 2 and carrier 7. The observation position 2 which is made in one piece can be attached to the attachment and lifting means frictionally engaged, positively and/or adhesively by means of adhesive. The observation position 2 consists of an armored glass. It can likewise consist of a transparent, unarmored material, for example plexiglass.

Figure 6:
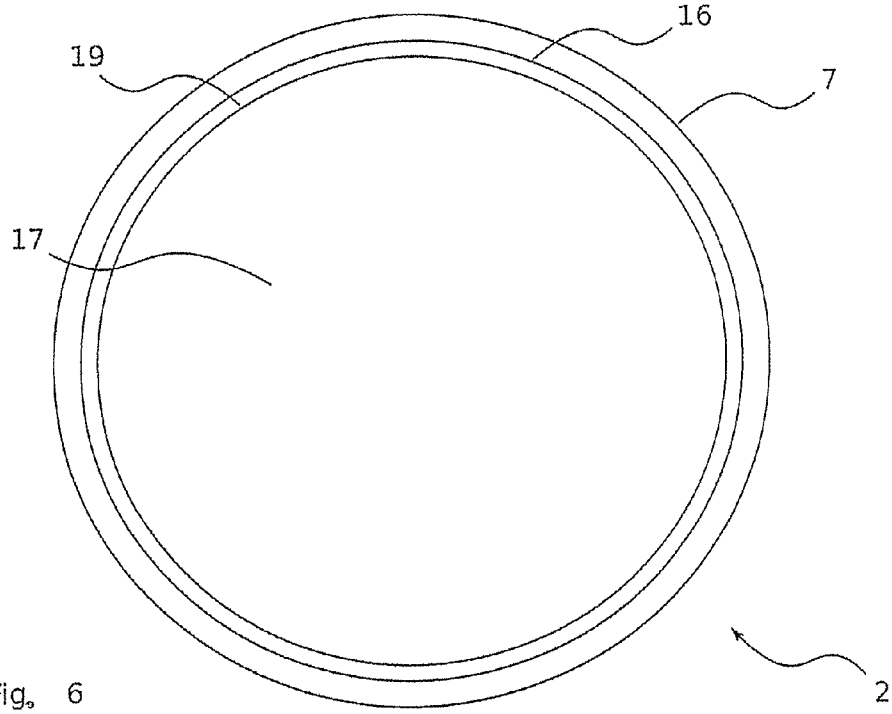
FIG. 6 shows a schematic plan view of the observation position of FIG. 5.

FIG. 6 shows a plan view of the observation position 2 as claimed in the invention from FIG. 5. The observation position is made in one piece and consists of glass.

Figure 7:
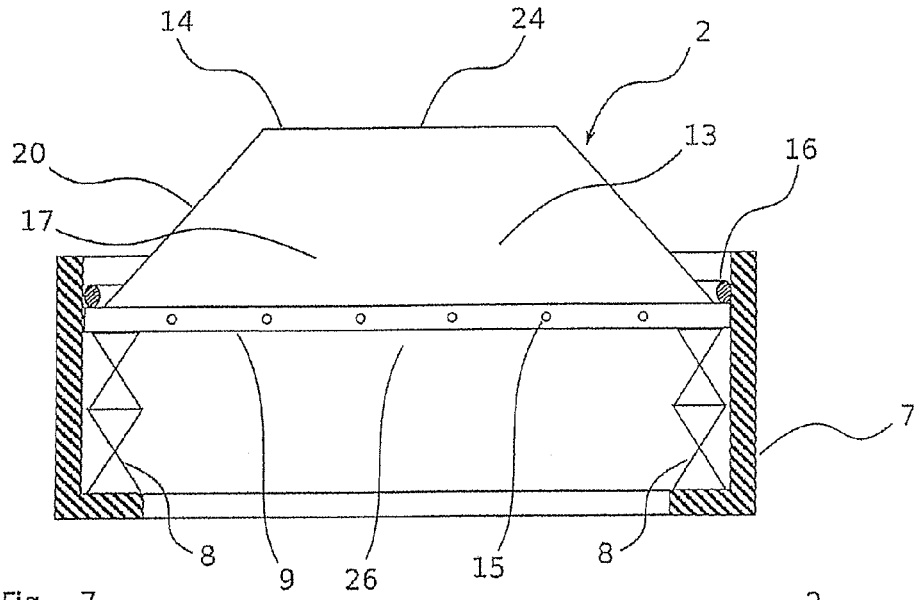
FIG. 7 shows a schematic side view of the observation position of the third embodiment.

FIG. 7 shows a schematic side view of one observation position of the third embodiment. The observation position 2 as claimed in the invention which is shown here and which has the shape of a truncated pyramid, the carrier 7 and the attachment and lifting means 8 have the same structure as the cuboidal observation position shown in FIG. 2. The observation position 2 is made in the form of a truncated pyramid 20 which is matched to the upper body of a human. A seal 16 is mounted between the bottom element 9 and carrier 7.

Figure 8:
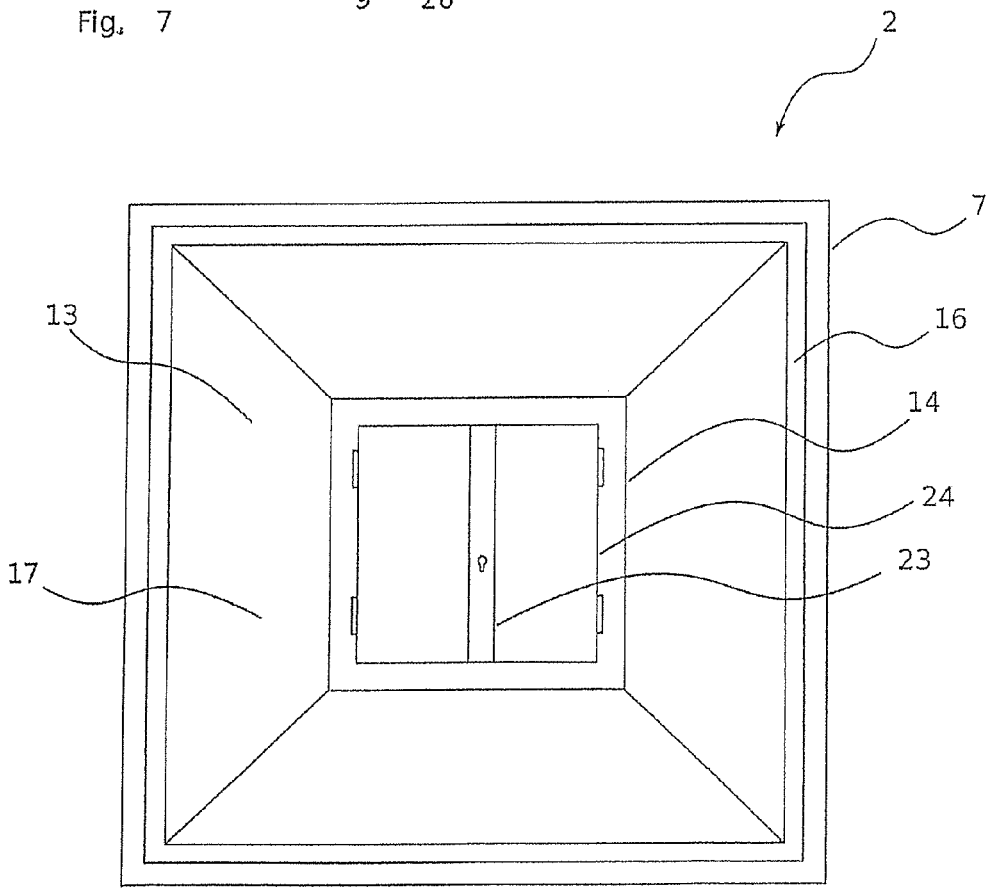
FIG. 8 shows a schematic plan view of the observation position of FIG. 7.

FIG. 8 shows a schematic top view of the observation position of FIG. 7. In the region of the roof element 14 of the observation position an opening and closing site 23 is made as an escape hatch 24. The escape hatch 24 can be manually opened in an emergency.

Figure 9:
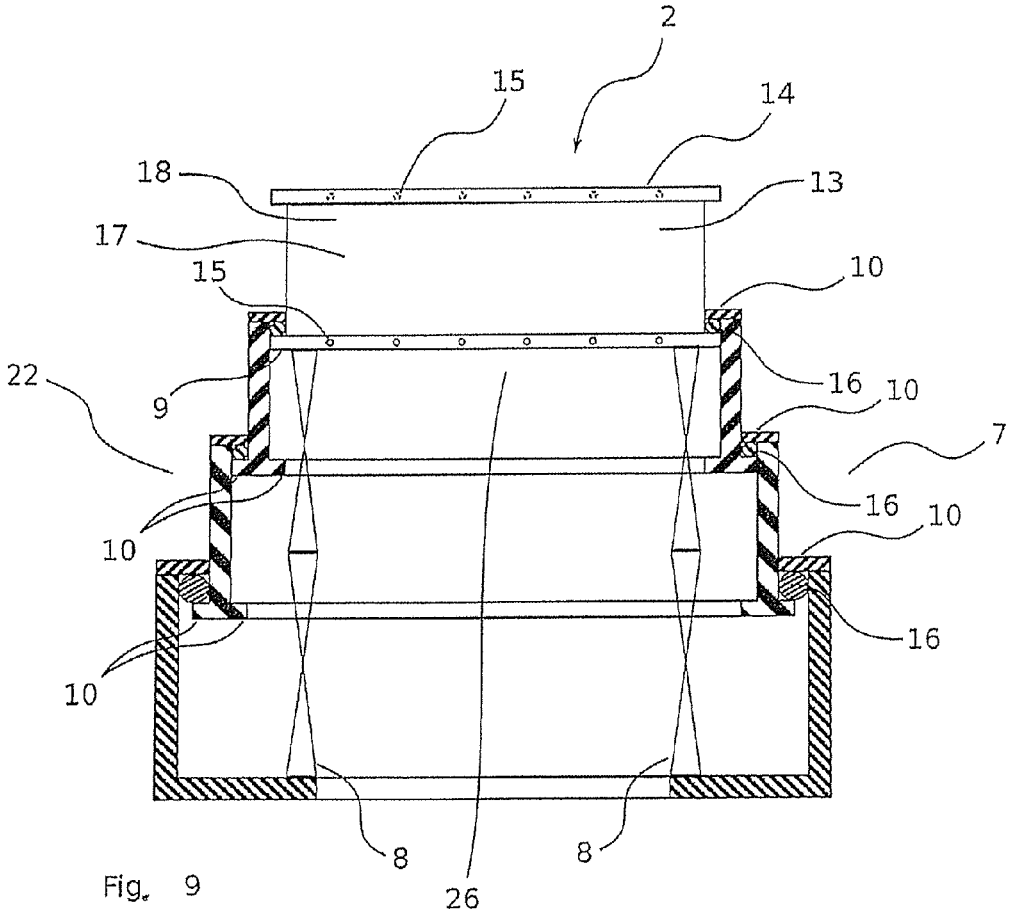
FIG. 9 shows a schematic side view of the observation position of the fourth embodiment.

FIG. 9 shows a schematic side view of one observation position of the fourth embodiment. The observation position 2 as claimed in the invention shown in the form of a cuboid 18 and the attachment and lifting means 8 have the same structure as the cuboidal observation position shown in FIG. 2. The observation position 2 shown here can also be made in other forms, for example, cylindrical. The carrier 7 has the shape of a telescoping tube 22 matched to the shape of the observation position 2, the individual segments having drivers 10 which enable extension and retraction as claimed in the invention.

Figure 10:
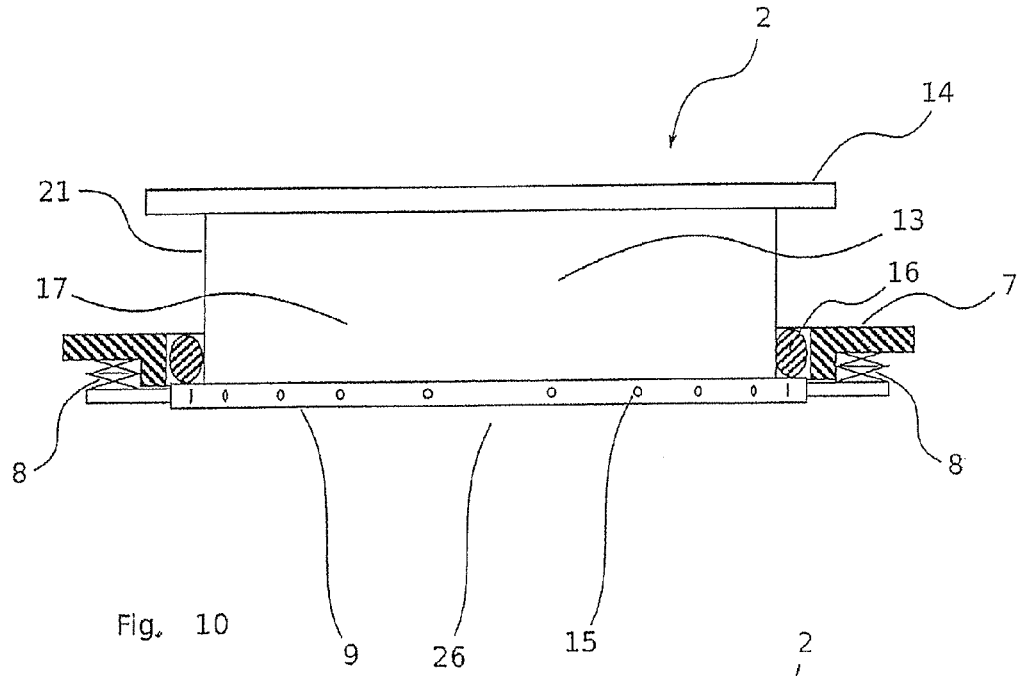
FIG. 10 shows a schematic side view of the observation position of the fifth embodiment.

FIG. 10 shows a schematic side view of one observation position of the fifth embodiment. The observation position 2 as claimed in the invention which is shown here in the form of a cylinder 21 is located in a carrier 7 and has a fastening and lifting means 8 connected to it. In this embodiment the attachment and lifting means 8 is located at the height of the observation position 2 outside the carrier. The bottom element 9 of the observation position 2 is lengthened and connected to the attachment and lifting means 8. When installed in a vehicle, parts of the carrier 7 are located in the vehicle interior. Alternatively installation on the outside of the armored roof section is also possible.

Figure 11:
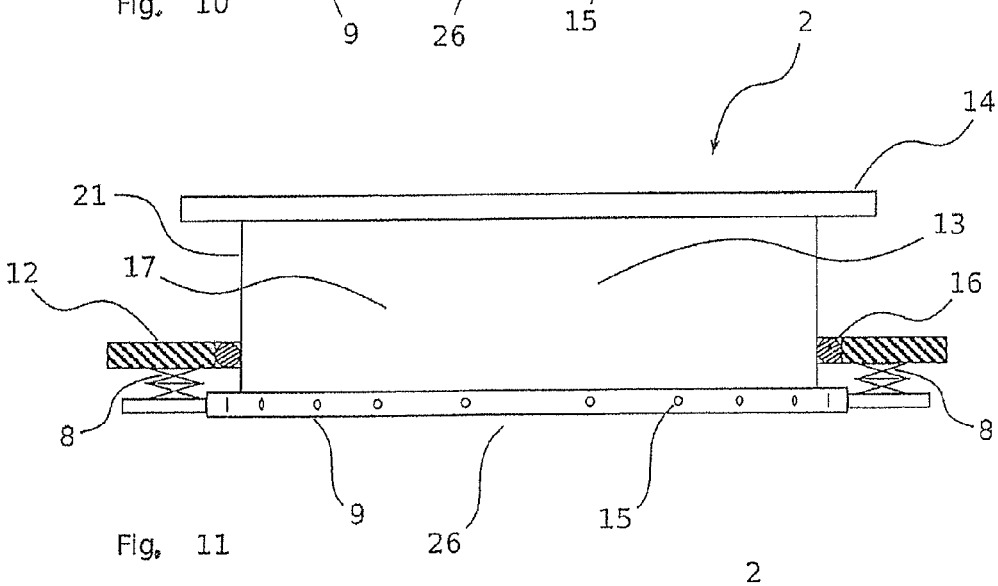
FIG. 11 shows a schematic side view of the observation position of the sixth embodiment.

FIG. 11 shows a schematic side view of an observation position of the sixth embodiment. The observation position 2 as claimed in the invention which is shown here, in the form of a cylinder 21, the carrier 7 and the attachment and lifting means 8 have the same structure as the cylindrical observation position shown in FIG. 10. The attachment and lifting means 8 are attached directly to the armored roof plane 12 which thus performs the function of the carrier, without using a carrier.

Figure 12:
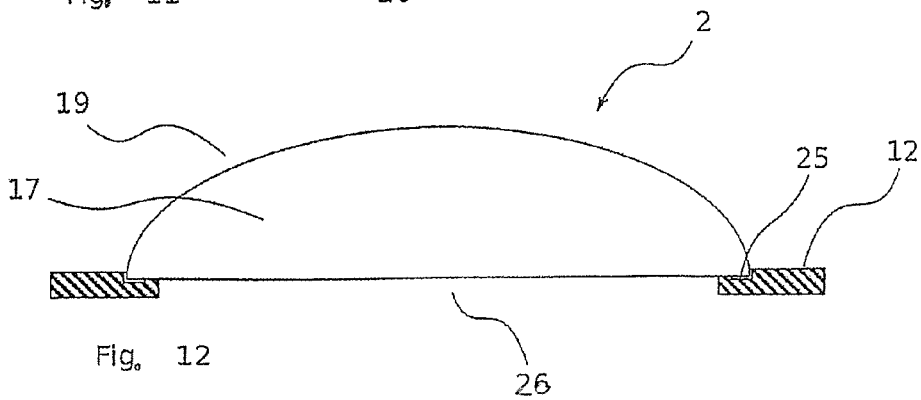
FIG. 12 shows a schematic side view of the observation position of the seventh embodiment.

FIG. 12 shows a schematic side view of an observation position of the seventh embodiment. The observation position 2 in the form of a cupola 19 is made of a transparent material 17, for example armored or unarmored glass, and has an opening 26 downward. It is fixed by supports 25 on the armored roof plane 12.

Figure 13:
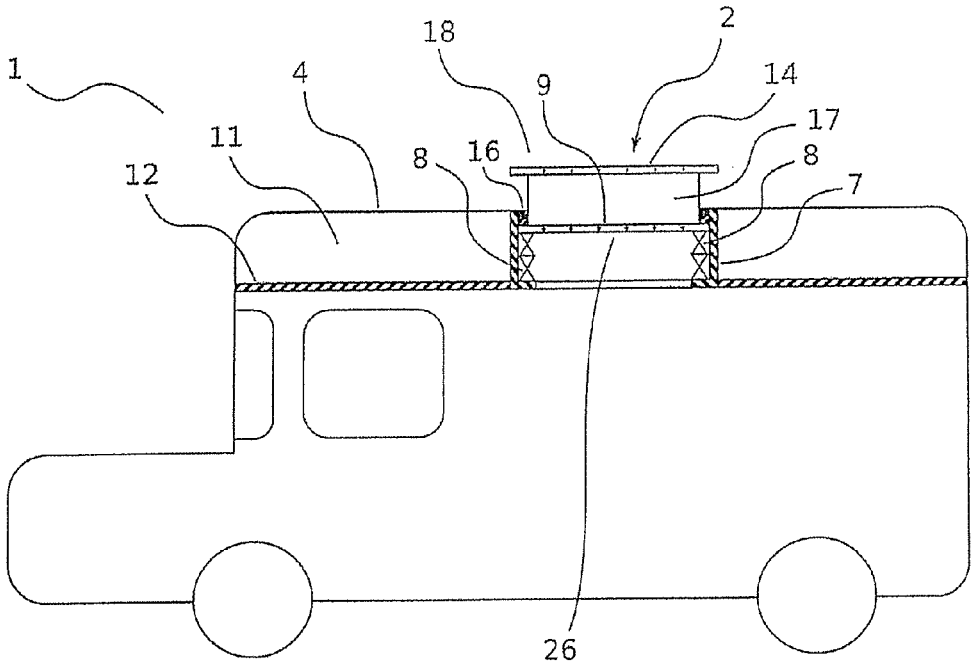
FIG. 13 shows a schematic side view of a vehicle with installed observation position of FIG. 2.

FIG. 13 shows a schematic side view of a vehicle with the installed cuboidal observation position of FIG. 2. The carrier 7 is located on the armored roof plane 12. The roof section 4 of the vehicle 1 is raised only to the top of the carrier so that a cavity 11 results.

Figure 14:
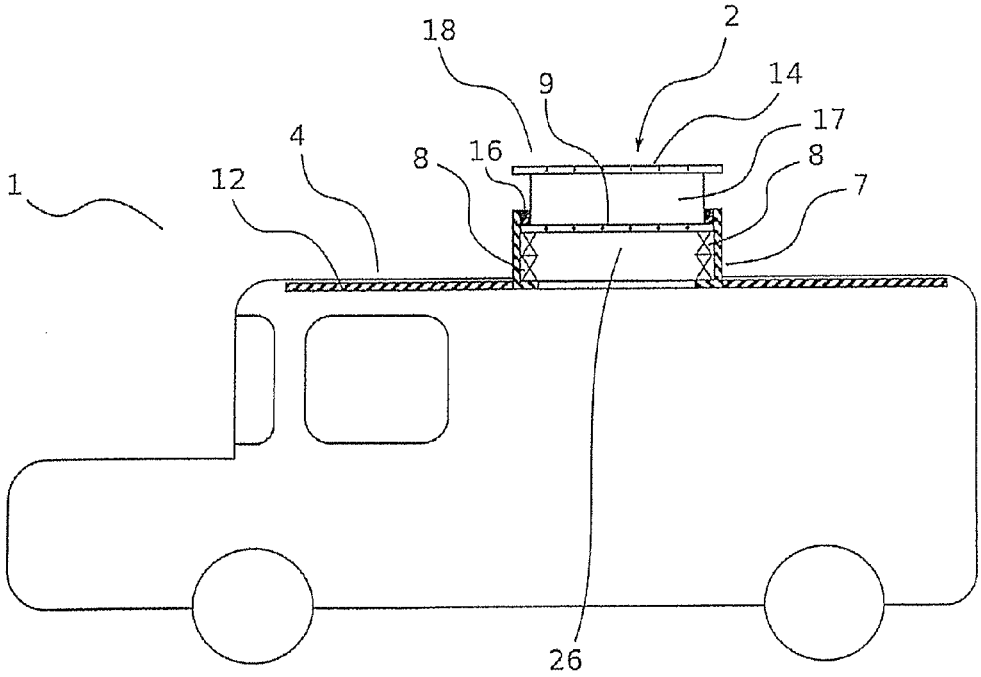
FIG. 14 shows a schematic side view of a vehicle with installed observation position of FIG. 2.

FIG. 14 shows a schematic side view of vehicle with the installed cuboidal observation position of FIG. 2. The carrier 7 is located on the armored roof plane 12.

The description of the invention by the figures relates mainly to armored vehicles. But it also applies to other types of vehicles. Vehicles 1 with an observation position 2 can be among others passenger vehicles of varied design, among others, but not solely all-terrain vehicles, SUVs, limousines, station wagons, armored and unarmored, a truck, a tractor, a special-purpose military or civilian vehicle, a tank, a rail car or water craft, and a stationary object like a military container. An observation position can also be made as a cone, truncated cone, pyramid, gable or in another geometrical shape not shown here. The observation position 2 is used mainly by security personnel and the media and also by hunters.

The invention claimed is:

1. A device for a vehicle comprising at least one armored bottom section which is located on a bottom of the vehicle, at least one armored side section which is located on a side of the vehicle and an armored roof plane which is located on a roof section of the vehicle, and in a region of the roof section at least one observation position which is structured to be moved in translation by at least one mechanism which is attached to a carrier, and the observation position is one piece and the observation position is made of a transparent material.

2. The device as claimed in claim 1, wherein the mechanism attached to the carrier is at least one of an attachment and lifting mechanism and the observation position can be at least axially fixed by the mechanism.

3. The device as claimed in claim 1, wherein the carrier is formed within or entirely or partially outside the vehicle.

4. The device as claimed in claim 2, wherein a vertical position of the observation position is structured to be changed by the lifting mechanism, the lifting mechanism acting at least one of electrically and hydraulically and mechanically and pneumatically and manually actuated.

5. The device as claimed in claim 4, wherein a vertical path of movement of the observation position is in the range from 10 to 200 cm, and a bottom element of the observation position is located at least partially in the carrier.

6. The device as claimed in claim 2, wherein the observation position is stationary on the roof section, and the lifting mechanism is replaced by a fixed support.

7. The device as claimed in claim 1, wherein the observation position is a hollow body.

8. The device as claimed in claim 1, wherein at least one of at least one side element and at least one roof element and at least one bottom element of the observation position is connected using a connecting mechanism at least one connection site, which is at least one of positively, nonpositively and adhesively.

9. The device as claimed in claim 8, wherein the side elements and the roof element of the observation position can be connected by at least one of bolting and cementing and riveting and tacking.

10. The device as claimed in claim 1, wherein at least one seal is mounted between the observation position and the carrier.

11. The device as claimed in claim 1, wherein at least one of the observation position and the carrier have a telescoping mechanism.

12. The device as claimed in claim 1, wherein the observation position and part of the carrier made above the armored roof section are made of a material with which a pressure wave of at least one of a detonation and of a bullet and an impact can be diverted.

13. The device as claimed in claim 12, wherein the observation position is made of at least one of a glass and ceramic glass.

14. The device as claimed in claim 1, wherein one region of the observation position has an escape hatch comprising an opening and closing site.

15. The device as claimed in claim 1, wherein within the observation position there is at least one of a measurement, observation, transmitting and receiving mechanism.

16. The device as claimed in claim 1, wherein the roof section of the vehicle is structured as a carrier, and at least one part of the observation position is located at a site within the roof section.

17. A vehicle equipped with a device according to claim 1.

18. A method for producing a device for investigating the vicinity for a vehicle as claimed in claim 17, wherein in the region of the roof section there is at least one observation position which is structured to be moved in translation by at least one mechanism attached to a carrier, and wherein the observation position is made in one piece and the observation position is made of a transparent material.

19. The device as claimed in claim 3, wherein the carrier is formed within or entirely or partially outside the vehicle in the region of the roof section.

20. The device as claimed in claim 5, wherein the vertical path of movement of the observation position is in the range between 10 cm and 50 cm.

21. The device as claimed in claim 7, wherein the observation position is at least one of a cuboid and cupola and a truncated pyramid and a cylinder and a pyramid and a cone and a truncated cone and a gable which has an opening downward.

22. A device for a vehicle, comprising at least one observation position which is structured to be moved in translation by at least one mechanism which is attached to a carrier, and that the observation position is one piece and the observation position is transparent.

23. The device as claimed in claim 1, wherein the carrier is formed within the vehicle.

24. The device as claimed in claim 22, wherein the observation position and part of the carrier are made:

above an armored roof section;

of a material with which a pressure wave of at least one of a detonation and of a bullet and an impact can be diverted; and the observation position is made of at least one of a glass and ceramic glass.

25. The device as claimed in claim 22, wherein one region of the observation position has an escape hatch comprising an opening and closing site.

26. The device as claimed in claim 22, wherein at least one seal is mounted between the observation position and the carrier.

27. The device as claimed in claim 22, wherein a bottom element of the observation position is lengthened and connected to an attachment and lifting mechanism outside of the vehicle.

28. The device as claimed in claim 22, wherein parts of the carrier are located in the vehicle.

29. A device for a vehicle, comprising:

at least one observation position which is structured to be moved in translation by at least one mechanism attached to a carrier, wherein:

the observation position is one piece;

the carrier comprises telescoping tubes;

the observation position is provided on a uppermost one of the telescoping tubes;

the telescoping tubes having a shape that matches to the observation position;

seals are provided between each of the telescoping tubes, including the uppermost one of the telescoping tubes and the observation position; and the one mechanism comprises an attachment and lifting mechanism extending between a bottom element of the observation position and the carrier.

* * * * *